US006923574B2

(12) United States Patent
Siegel

(10) Patent No.: US 6,923,574 B2
(45) Date of Patent: Aug. 2, 2005

(54) FLEXIBLE POUCH WITH REINFORCED HANDLE

(76) Inventor: Kenneth D. Siegel, 1906 Grant Ave., Suite E, Redondo Beach, CA (US) 90278

( * ) Notice: Subject to any disclaimer, the term of this patent is extended or adjusted under 35 U.S.C. 154(b) by 0 days.

(21) Appl. No.: 10/277,994

(22) Filed: Oct. 23, 2002

(65) Prior Publication Data

US 2003/0077006 A1 Apr. 24, 2003

Related U.S. Application Data

(60) Provisional application No. 60/335,433, filed on Oct. 23, 2001.

(51) Int. Cl.[7] ..... B65D 33/08
(52) U.S. Cl. ..... 383/10; 383/17
(58) Field of Search ..... 383/10, 17, 20, 383/9, 28, 6

(56) References Cited

U.S. PATENT DOCUMENTS

| | | | | | |
|---|---|---|---|---|---|
| 2,878,849 | A | * | 3/1959 | Lingenfelter et al. | 383/9 |
| 3,302,860 | A | | 2/1967 | Schwarzkopf | |
| 3,332,420 | A | * | 7/1967 | Voller | 604/182 |
| 3,440,124 | A | | 4/1969 | Schwarzkopf | |
| 3,462,069 | A | * | 8/1969 | Suominen | 383/10 |
| 3,732,661 | A | * | 5/1973 | Goldberger et al. | 53/134.1 |
| 4,353,460 | A | * | 10/1982 | Kahn | 206/3 |
| 4,846,587 | A | * | 7/1989 | Hull | 383/10 |
| 5,065,868 | A | * | 11/1991 | Cornelissen et al. | 206/494 |
| 5,077,064 | A | * | 12/1991 | Hustad et al. | 426/106 |
| 5,593,229 | A | | 1/1997 | Warr | |
| 5,758,971 | A | | 6/1998 | Goglio et al. | |
| 6,053,635 | A | * | 4/2000 | Anderson et al. | 383/10 |

FOREIGN PATENT DOCUMENTS

| | | | | |
|---|---|---|---|---|
| DE | DT 1486208 | * | 2/1969 | 383/10 |
| DE | DT 2357667 | * | 9/1975 | 383/10 |
| EP | 0 370 957 A1 | * | 11/1989 | 383/906 |
| FR | 2 592 561 | | 1/1986 | |
| GB | 1141841 | * | 2/1969 | 383/10 |

* cited by examiner

*Primary Examiner*—Jes F. Pascua
(74) *Attorney, Agent, or Firm*—Cislo & Thomas LLP

(57) ABSTRACT

A flexible pouch of plastic material forms a container having opposed front and back walls, opposed closed side end walls and closed top and bottom walls, a handle formed in the front and back walls for gripping and manipulating the container, the handle comprising a frame member of plastic material having a central opening, the frame member being disposed within the front and back panels which are sealed together along at least the outer periphery of the frame member for snugly encapsulating the frame member in place between the front and back panels, and through openings in the front and back walls are coincident to the central opening of the frame member through which the hand of the user can extend for grasping one of the frame sides of the frame member.

20 Claims, 3 Drawing Sheets

FLEXIBLE POUCH WITH REINFORCED HANDLE

This application claims benefit of Ser. No. 60/335,433 filed Oct. 23, 2001.

BACKGROUND OF THE INVENTION

This invention relates to a flexible pouch or bag of plastic material especially designed for granular or viscous products, and more particularly to such a flexible pouch having a reinforced handle enabling the filled bag to be gripped and manipulated with ease.

The prior art discloses, as for example, through U.S. Pat. Nos. 3,302,860 and 3,440,124, griphole carrying bags having separate reinforcing elements secured as by heat sealing to external surfaces of both front and back panels of the bag along the edge of each griphole formed in the front and back panels. External reinforcing elements of such type, however, are costly to produce inasmuch as a pair of such elements are required for each bag and may interfere with high speed production operations in the manufacture of the bags and the assembly of such reinforcing elements. The external reinforcements prevent bags during the production operation from lying flat one on top of the other which may interfere with ease in handling. Moreover, the external reinforcement elements could interfere with handling the equipment during bag production and are moreover susceptible to being dislodged from the front and back panels during various stages of the production.

Internal reinforcements for bag gripholes are disclosed in French patent 2,592,561 in that reinforcement bars extending substantially along the entire width of the bag are encased in turned-over, open, upper portions of the front and back panels of the bag and are sealed in place immediately above the upper edge of a griphole in the front and back panels. Again, however, a pair of reinforcement bars is required for each bag thereby adding to the cost and the complexity of production. Moreover, since the reinforcement bars are encased in turned-over upper portions of the front and back panels of the bag before being sealed in place, such an operation is time-consuming and costly in the production of such bags which may not be of the reusable type such that low cost is a major factor in the production and successful commercialization of the bags.

SUMMARY OF THE INVENTION

It is therefore an object of the present invention to provide a reinforced handle for a flexible pouch or bag requiring but a unitary reinforcement member for each bag in a manner which is highly economical and effective in mass producing handle reinforced bags quickly and cheaply without the problems encountered by the prior art requiring either pairs of external reinforcements or pairs of internal reinforcements which must be encased within folded upper portions of the bags.

In keeping with this objective, the flexible pouch according to the invention has a handle formed in the front and back walls of the pouch and lies adjacent the top, bottom or one of the side end walls of the pouch for purposes of gripping and manipulating the pouch with ease. The handle is in the form of a frame member of plastic material having a central opening, the frame being of some suitable shape, such as oval, D-shaped, rectangular, etc. The frame member is located between the front and back walls of the pouch which are sealed together along at least an outer periphery of the frame member and which may be sealed to the frame member itself for snugly retaining the frame member in place between the front and back walls. And, through openings are formed in the front and back walls at the central opening of the frame member to facilitate extension of the hand of the user for grasping one of the frame sides of the frame member facilitating ease in gripping and manipulating the pouch which may be filled with heavy granular material or the like.

In accordance with other objectives of the invention, the through openings in the front and back walls coincident with the central opening of the frame member can be formed by diecut openings during some suitable stage of the bag production process. The diecut openings maybe complete or partial and if the latter can thereby form flaps which overlie an inner edge of the one frame side wall which is gripped by the user.

The front and back walls of the pouch together may be heat sealed together along the outer periphery of the frame member and to the frame member, or by sonic welding. And, portions of the front and back walls of the pouch within the confines of the inner periphery of the frame member can be defined by a continuous line of weakening formed by connecting ties facilitating the removal of such portions to gain access to the handle, or can be formed by a line of weakening at the inner periphery of the frame member except at one of the frame sides of the frame member so as to form flaps which can overly the gripped side of the frame member by the user.

The handles may be assembled as in accordance with the foregoing during in-line production of the pouches, or may be assembled to a pre-formed pouch by insertion within a pre-formed pocket located in the front and back walls, after which the pocket is closed by heat sealing or sonic welding.

Other objects, advantageous and novel features of the invention will become more apparent from the following detailed description of the invention when taken in conjunction with the accompanying drawings.

BRIEF DESCRIPTION OF THE DRAWINGS

FIG. 1(*b*) is a cross sectional view taken generally along line 1(*b*)—1(*b*) in FIG. 1(*a*), illustrating the opposed closed side end walls of the pouch of FIG. 1(*a*);

FIG. 1(*c*) is a cross sectional view taken generally along line 1(*c*)—1(*c*) in FIG. 1(*a*), illustrating the closed top and bottom walls of the pouch of FIG. 1(*a*);

DETAILED DESCRIPTION OF THE INVENTION

Figure 1A:
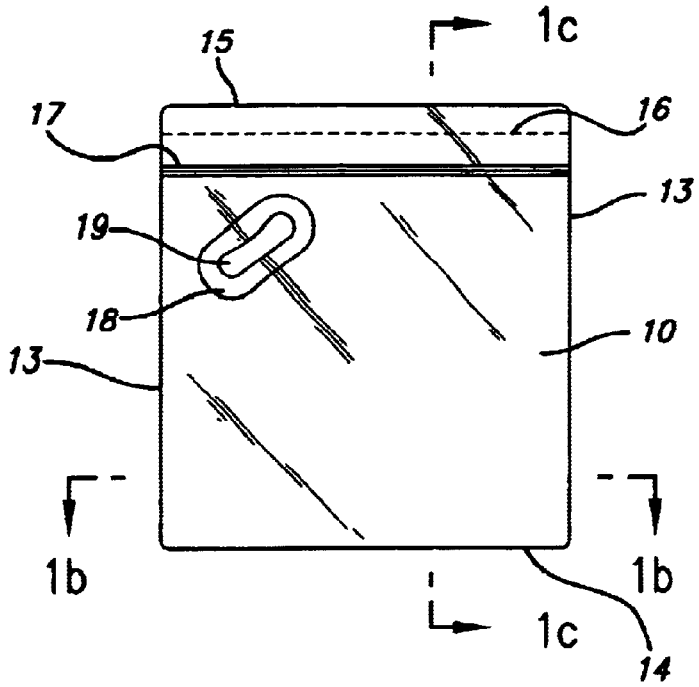
FIG. 1(*a*) is a schematic front elevational view of a pouch containing a reinforced handle according to one embodiment of the invention.
Figure 1B:
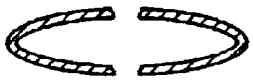
Figure 1C:
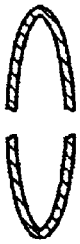

Turning now to the drawings wherein like reference characters refer to like and corresponding parts throughout the several views, the schematic view of a flexible pouch or bag according to the invention is generally designated 10 in FIG. 1(*a*) as comprising at least a single ply of flexible plastic material having front and back panels 11, 12 (FIG. 5) which are closed along the sides 13 as well as along bottom 14 and top 15. The bag may be formed such that one or more sides of the pouch are gusseted. And, the bag may be opened by cutting or tearing along a tear line 16 at the top, and may be resealable by pressing along a conventional resealable bead-groove line 17 as in any normal manner. Otherwise, the bag may be formed in some other customary manner as from a continuous tube of plastic material which is cut to length and which is then sealed along bottom 14, and sealed along top 15 after which tear lines and resealable bead-groove lines may be applied if desired.

Figure 2:
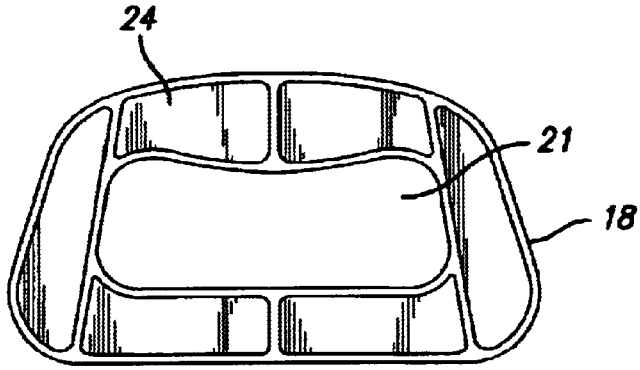
FIG. 2 is a plan view of a handle reinforcement comprising a frame member according to one embodiment of the invention.
Figure 3:
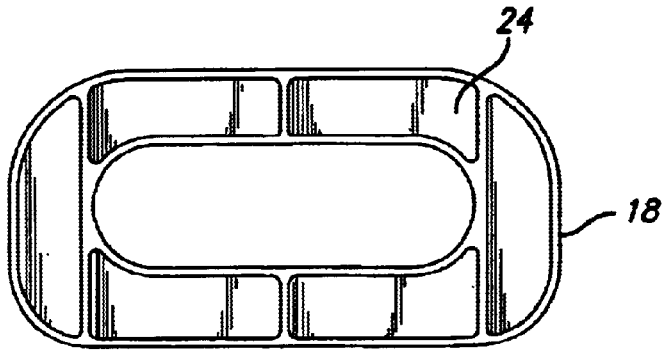
FIG. 3 is a view similar to FIG. 2 of a handle according to another variant of the invention.

In accordance with the invention, a plastic handle 18 in the form of an enclosed frame of a desired overall shape such as that shown in FIG. 2, or in FIG. 3 or in accordance with any other suitable design, provides internal support and reinforcement for griphole 19 formed as through openings in the front and back pouch panels 11, 12 coincident to central opening 21 of handle frame member 18.

Figure 5:
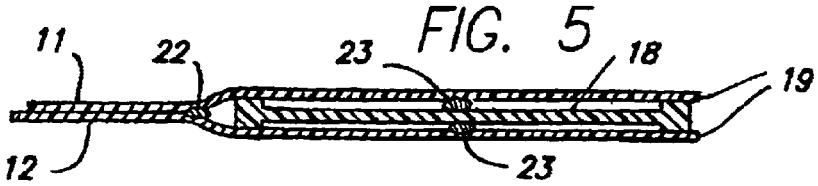
FIG. 5 is a sectional view taken substantially along the line 5—5 of FIG. 4.
Figure 4:
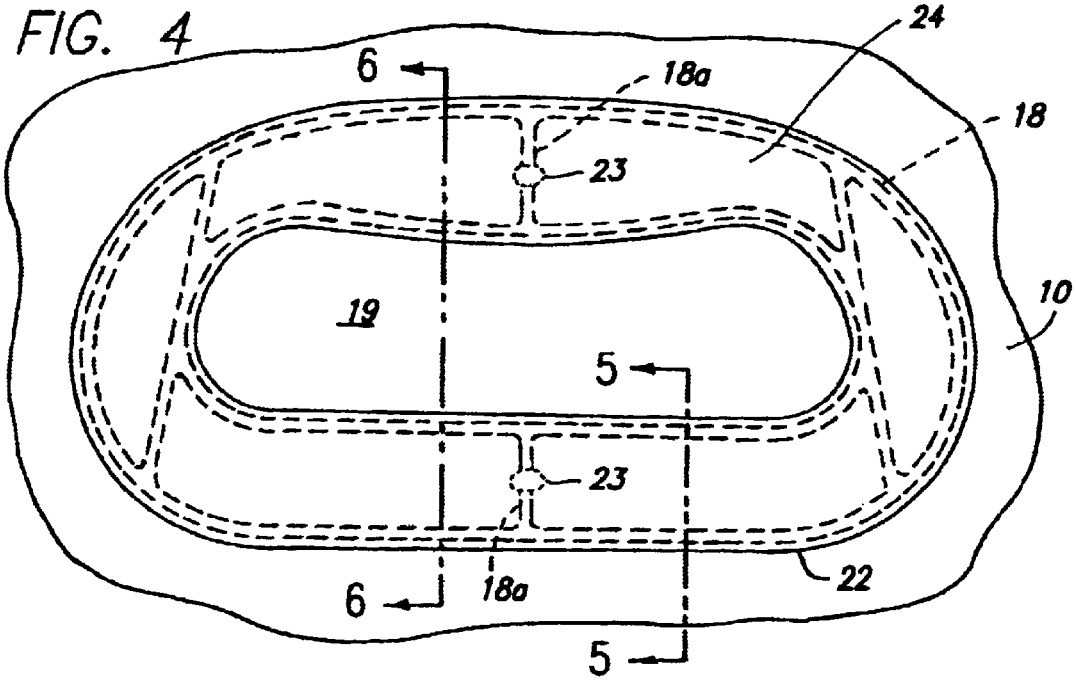
FIG. 4 is a plan view at an enlarged scale of a portion of a flexible bag having a reinforced handle according to the invention assembled in place.

As illustrated in greater detail in FIGS. 4 and 5, during some suitable step in the process of in-line bag production, frame member 18 is disposed between front and back panels 11 and 12 of the bag with central opening 21 of the frame member generally sized with the through openings provided in the front and back panels which form a griphole. The handle or frame member 18 can be of any suitable thermoplastic material (LLDPE, LDPE), rigid or semi-rigid, and injection molded which as will be seen is encapsulated between the front and back panels of the pouch. The front and back panels are heat sealed together as at 22 along the outer periphery of handle 18, and may likewise be heat sealed to one or both sides of handle 18 as at 23 to ribs 18*a* of the frame member. Otherwise, the front and back panels can be sonic welded as at 22 and 23 with seal or weld 22 being either a continuous and uninterrupted closed loop or being an interrupted closed loop, pursuant to the invention. The handle member is thus completely encapsulated between the front and back panels of the bag, and one leg or side of the frame such as 24 serving as a gripped portion of the frame which is grasped by the user for manipulating and gripping the pouch after the user's hand is extended through openings 19 and 21.

Figure 6:
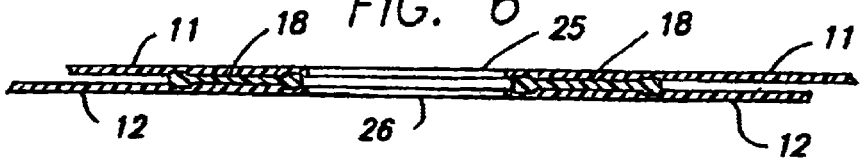
FIG. 6 is a schematic view taken substantially along the line 6—6 of FIG. 4 according to one embodiment of the invention.

The through openings 19 in front and back panels 11, 12 which may essentially coincide with central opening 21 of the encapsulated handle may be either formed as diecut openings during bag production in which case portions of the front and back panels at central opening 21 are removed by reason of the diecutting operation. Otherwise, the through openings 19 can be provided by a diecut along the three sides of the frame except along that portion of the inner edge of side or leg 24 of the frame such that, as schematically illustrated in FIG. 6, and in FIG. 7, flaps 25, 26 are thereby formed which may be folded to either overlie back panel 12 or to overlie front panel 11 so as to thereby overlie the inner edge of leg 24. In such manner the flaps add to the comfort for the user when gripping leg 24 of the handle.

Figure 7:
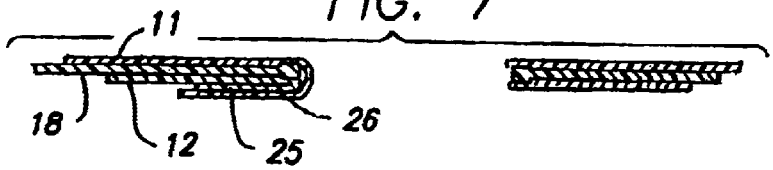
FIG. 7 is a view similar to FIG. 6 showing flaps formed in the FIG. 6 embodiment which are folded over a portion of the frame member.
Figure 8:
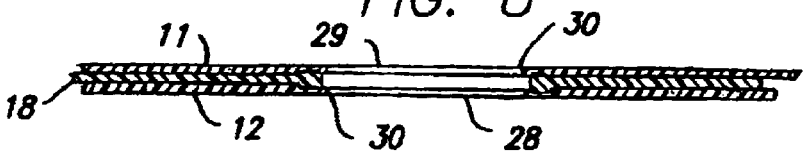
FIG. 8 is a view similar to FIG. 6 of another embodiment according to the invention.

Otherwise, the through openings 19 in the front and back panels at central opening 21 of the handle may be formed by a series of perforations or tiny connecting ties 30 along the inner periphery of the handle such that, as schematically shown in FIG. 8, portions 28 and 29 can be either completely removed forming through openings 19 in the front and back panels or can be partially removed forming flaps similar to that of flaps 25, 26 of the FIGS. 6, 7 embodiment.

In accordance with the invention, handle 18 may be of a wide variety of shapes such as that shown in FIG. 3 and in any one of FIGS. 9 to 14, or any other suitable shape, so long as the frame present a side or a leg such as 24 which can be conveniently gripped by the user.

Figure 9:
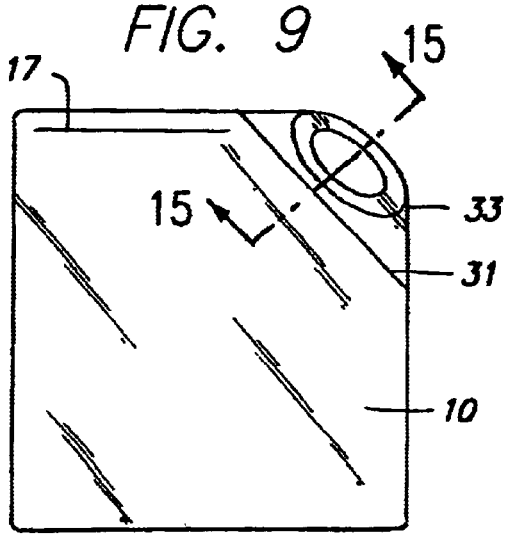
FIGS. 9 to 14 are views similar to FIG. 1(*a*) of pouches having reinforced handles according to other variants of the invention.
Figure 10:
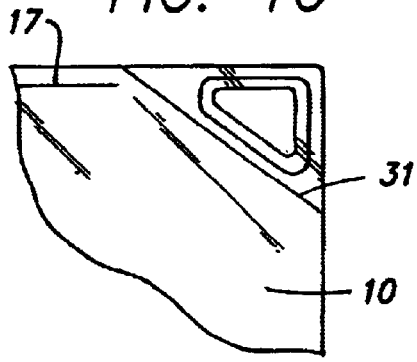
Figure 11:
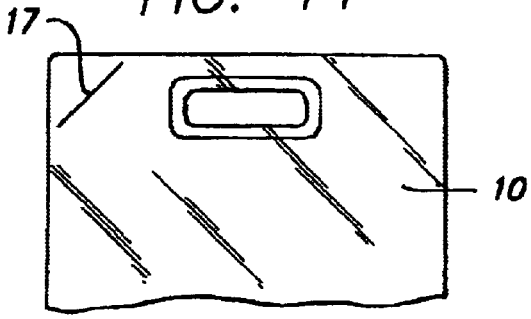
Figure 12:
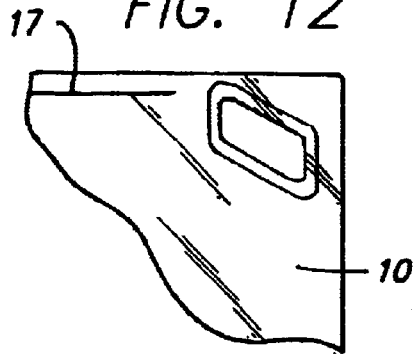
Figure 15:
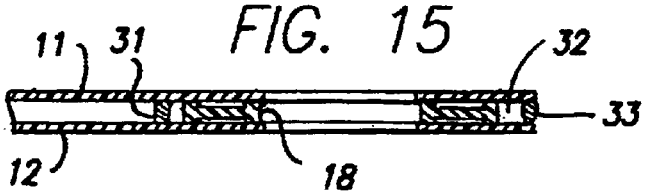
FIG. 15 is a schematic view taken substantially along the line 15—15 of FIG. 9 of a pocket-inserted reinforcement handle.

The handle of the invention may, alternatively, be assembled in place within a pocket provided in the bag, after the bag is formed, by sealing the front and back panels together as along a line 31 shown in FIGS. 9 and 10. The pocket is shown more clearly as at 32 in FIG. 15 thereby permitting the handle according to the invention to be encapsulated within the front and back panels of the pouch as it is inserted into the pocket after which the front and back panels are sealed together as at 33 thereby completely encapsulating the handle within the pocket.

Figure 13:
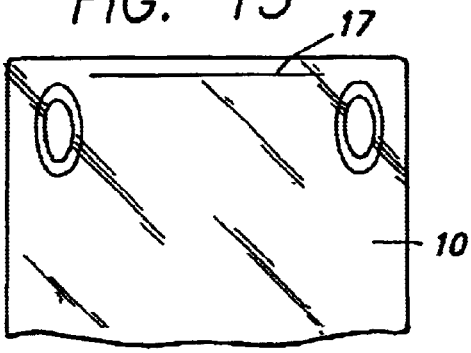
Figure 14:
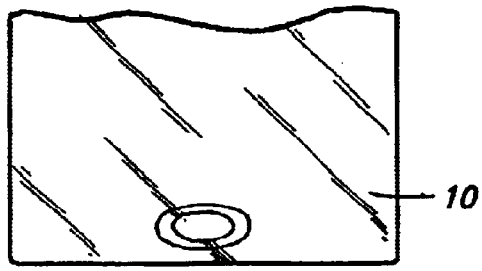

FIGS. 9 to 14 illustrate handles of various possible shapes located adjacent one of the top, bottom or side end walls of the container for gripping and manipulating the container in the manner according to the invention. It can be seen that the handle in FIGS. 9, 13 and 14 is substantially oval and is symmetrical about its major axis. And, in FIG. 11 the handle is shown substantially rectangular and is symmetrical about its major axis.

From the foregoing it can be seen that a simple and efficient yet highly effective handle reinforcement is provided for a pouch or bag facilitating easy and convenient gripping and manipulating of the pouch by the user. The handle with griphole is located within the overall periphery or "footprint" of the bag so that it does not extend outwardly therefrom, and the pouch can be utilized conveniently for containing pet foods, lawn and garden fertilizers, and other relatively bulky and dense products. The handle supports and reinforces the weight of the pouch and prevents the pouch from tearing or ripping. It is also more comfortable in the consumer's hand and does not project outwardly from the bag, so that it is aesthetically pleasing.

Obviously, many modifications and variations of the present invention are made possible in the light of the above teachings. It is therefore to be understood that within the scope of the appended claims the invention may be practiced otherwise than as specifically described.

What is claimed is:

1. A flexible pouch for containing a granular or viscous product, comprising at least one ply of flexible plastic material forming a container having opposed front and back walls with a predetermined width and a predetermined height, opposed closed side end walls and closed top and bottom walls peripherally bounding an interior region, a handle provided in said front and back walls spaced a predetermined distance from one of said top, bottom and side end walls for gripping and manipulating the container, the handle comprising a frame member of plastic material having formed thereon a plurality of raised ribs and defining a central opening, the frame member being disposed between the front and back walls, and the frame member having a width and height substantially less than the predetermined width and predetermined height, respectively, of the front and back walls to be disposed within a portion of said interior region and spaced by said interior region from at least two of said top, bottom and side walls of the container, the handle being located adjacent a selected one of the top, bottom and side end walls of the container, said handle being sized to be located away from at least two of said top, bottom, left side and right side end walls of the container for providing access to contents of the container, means for retaining the frame member in place between the front and back walls comprising one of a seal for sealing the front and back walls together along an outer periphery of the frame member and seals for sealing the front and back walls to the frame member, and the front and back walls having through openings coincident to the central opening of the frame member through which the hand of a user can extend for grasping one frame side of the frame member for lifting and manipulating the pouch with ease, recloseable means being provided at one of said side, end, top and bottom walls for selective access to the contents of the container.

2. The flexible pouch according to claim 1, wherein the through openings in the front and back walls comprise diecut openings sized substantially to that of the central opening.

3. The flexible pouch according to claim 1, wherein the through openings in the front and back walls comprise diecut openings defined along only frame sides of the frame member other than said one frame side, portions of the front and back walls defined by the diecut openings thereby forming flaps which can be folded to overlie the one frame side for handle grip comfort purposes.

4. The flexible pouch according to claim 1, wherein the front and back walls are heat sealed together along the outer periphery of the frame member and the front and back walls are likewise heat sealed to the frame member.

5. The flexible pouch according to claim 1, wherein the front and back walls are sonic welded together along the outer periphery, and the front and back walls are likewise sonic welded to the frame member.

6. The flexible pouch according to claim 1, wherein portions of the front and back walls at the central opening of the frame member include a line of weakening formed by connecting ties along an inner periphery of the frame member which define the through openings upon hand extension by the user through the central opening of the frame member.

7. The flexible pouch according to claim 1, wherein portions of the front and back walls at the central opening of the frame member each include a line of weakening formed along an inner periphery of the frame member except at the one of the frame sides, the through openings being formed upon separation of the portions along each of the line of weakening, said portions thereby forming flaps which can overlie the one of the frame sides when grasped by the user.

8. The flexible pouch according to claim 1, wherein said retaining means comprises the seal for sealing the front and back walls together along the outer periphery of the frame member for snugly retaining the frame member in place.

9. The flexible pouch according to claim 1, wherein said retaining means comprise the seals for sealing the front and back panels to the frame member.

10. The flexible pouch according to claim 1, wherein the handle comprises a geometrical form having a major axis, and the handle being symmetrical about said axis.

11. The flexible pouch according to claim 1, wherein the handle is one of flat and ribbed.

12. The flexible pouch according to claim 1, wherein said recloseable means is provided at least one of: inline with said handle, above said handle and below said handle.

13. A pouch for containing a granular or viscous product, comprising at least one ply of flexible plastic material forming a container having opposed front and back walls with a predetermined width and a predetermined height, opposed closed side end walls and closed top and bottom walls peripherally bounding an interior region, a handle provided in said front and back walls spaced a predetermined distance from one of said top, bottom and side end walls for gripping and manipulating the container, the handle comprising a looped frame member insert of plastic material having formed on opposing sides thereof a plurality of raised ribs and defining at least one opening, the frame member being captured between the front and back walls, and the frame member having a width and height substantially less than the predetermined width and predetermined height, respectively, of the front and back walls to be disposed within a portion of said interior region and spaced by said interior region from at least two of said top, bottom and side walls of the container, the handle being located adjacent a selected one of the top, bottom and side end walls of the container, said handle being sized to be located away from at least two of said top, bottom, left side and right side end walls of the container for providing access to contents of the container, means for retaining the frame member in place between the front and back walls comprising one of a seal for sealing the front and back walls together along an outer periphery of the frame member and seals for sealing the front and back walls to the frame member, and the front and back walls having through openings coincident to the opening of the frame member through which the hand of a user can extend for grasping one frame side of the frame member for lifting and manipulating the pouch with ease, recloseable means being provided at one of said side, end, top and bottom walls for selective access inside the container.

14. The pouch according to claim 13, wherein the through openings in the front and back walls comprise diecut openings sized substantially to that of the opening.

15. The pouch according to claim 13, wherein the through openings in the front and back walls comprise diecut openings defined along only frame sides of the frame member other than said one frame side, portions of the front and back walls defined by the diecut openings thereby forming flaps which can be folded to overlie the one frame side for handle grip comfort purposes.

16. The pouch according to claim 13, wherein the front and back walls are heat sealed together along the outer periphery of the frame member and the front and back walls are likewise heat sealed to the frame member.

17. The pouch according to claim 13, wherein the front and back walls are sonic welded together along the outer periphery, and the front and back walls are likewise sonic welded to the frame member.

18. The pouch according to claim 13, wherein portions of the front and back walls centrally disposed relative to the frame member include a line of weakening formed by connecting ties along an inner periphery of the frame member which define the through openings upon hand extension by the user through the opening of the frame member.

19. The pouch according to claim 13, wherein portions of the front and back walls at the opening of the frame member each include a line of weakening formed along an inner periphery of the frame member except at the one of the frame sides, the through openings being formed upon separation of the portions along each of the line of weakening, said portions thereby forming flaps which can overlie the one of the frame sides when grasped by the user.

20. The pouch according to claim 13, wherein said recloseable means is provided at least one of: inline with said handle, above said handle and below said handle.

* * * * *